United States Patent [19]

Krause

[11] 4,064,710

[45] Dec. 27, 1977

[54] SAFETY DEVICE FOR KNITTING MACHINE

[75] Inventor: Erich Krause, Bopfingen, Germany

[73] Assignee: Universal Maschinenfabrik Dr. Rudolf Schieber KG, Westhausen, Germany

[21] Appl. No.: 729,626

[22] Filed: Oct. 5, 1976

[30] Foreign Application Priority Data

Oct. 10, 1975 Germany ..... 2545558

[51] Int. Cl.[2] ..... D04B 35/10

[52] U.S. Cl. ..... 66/157

[58] Field of Search ..... 66/157, 64, 60 R, 126 R

[56] References Cited

U.S. PATENT DOCUMENTS 824,565 6/1906 Morris ..... 66/157 X

FOREIGN PATENT DOCUMENTS 432,280 7/1926 Germany ..... 66/64

14,957 7/1897 Switzerland ..... 66/157

*Primary Examiner*—Wm. Carter Reynolds

*Attorney, Agent, or Firm*—Sughrue, Rothwell, Mion, Zinn and Macpeak

[57] ABSTRACT

A hood which is mounted to and shields a slide which in turn is longitudinally movable on a straight knitting machine, has contact devices for triggering a stopping mechanism for the knitting machine slide on the end faces of the hood as viewed in the direction in which the slide travels, with the hood being displaceable longitudinally relative to the slide through a distance corresponding to at least the braking distance of the slide after the stopping mechanism is triggered.

7 Claims, 7 Drawing Figures

SAFETY DEVICE FOR KNITTING MACHINE

BACKGROUND OF THE INVENTION

1. Field of the Invention

This invention relates to a knitting machine, especially a straight knitter, and to knitting machines having a stopping mechanism for a slide movable longitudinally on the knitting machine and which may be triggered in the event of danger of pinching of the operator s hand.

2. Description of the Prior Art

Knitting machines of this kind are disclosed in the publication "Strickerei-und Wirkerei-Technik", the issue of April 1963, No. 4. In such a knitting machine, a stopping mechanism is triggered to terminate movement of a movable part of the machine relative to a fixed part to provide protection against possible pinching of the operator's hand during manipulations while knitting is being carried out.

In the production of flat textile materials in meter runs of semi-regular goods or fully regular goods on straight knitters, it is always desirable and necessary to be able to continously supervise production. Any defects that may occur must be rapidly detected and must be capable of being removed. The more the knitting machine is open and readily accessible, the greater are the possibilities of effecting control and the easier it is for the operator to take steps to correct the operation of the knitting machine during knitting. One such step is necessary, for example, when the goods are to be pressed down between the combs by means of the stroking device during movement of the slide so as to permit dealing with bunching of the knitted material. Such stroking device, or stroker/sinker, is mounted in the stead of a yarn carrier to precede another carier, while feeding yarn, and engage the fabric, thereby precluding upward fabric movement with the needles.

An open design type of knitting machine permitting ready accessibility while the machine is operating, inevitably exposes the operator to danger since a number of places where pinching of the operator's hand can occur, cannot be avoided, particularly between the slide of the knitting machine and stationary parts secured to the machine frame. Hitherto, no means have been disclosed for preventing injuries by such pinching which have proved popular in practice.

A known protective arrangement consists in the provision of a fixed shield, cover or hood. Such covers have been found by the operators to constitute a hindrance to manipulations on the machine after the machine has been put into operation, and the operator in many cases simply sets the cover aside because of the inconvenience which the cover causes.

Also, large hinge hoods which cover the entire working area of the knitting machine are also known and oftentimes employed. However, such hoods have not been acceptable to the operators, particularly to the knitters since they do not permit any visual inspection whatsoever of the knitting machine when it is operating. Furthermore, it is impossible to adjust the operation of the machine unless the hoods are first removed.

Finally, use has been made of safety arrangements in the form of light-barrier systems built into the knitting machine. Such systems too suffer from the more serious of the above mentioned disadvantages, particularly the impossibility of adjusting the operation of the machine without switching off the light barriers.

The object of the present invention is to provide a safety device for a knitting machine that not only provides protection against injury, particularly injuries at places where pinching of the operator's hand may occur between the slide and other fixed parts on the machine frame, but also a device which is totally acceptable to the machine operator and is not circumvented by such operator.

According to the invention, this object is achieved by the employment of a hood which is mounted on the slide, movable with the slide and also movable relative to the slide in a direction in which the latter moves and is further mounted so as to be swung up transversely to the direction in which the slide moves in a contact device for triggering the stopping mechanism of the knitting machine provided on the end faces of the hood as viewed in the direction in which the slide travels. Further, the hood is displaceable relative to the slide through a distance corresponding to the braking distance of the slide after the stopping mechanism has been triggered.

In the safety device of the present invention, the contact devices trigger the stopping mechanism of the knitting machine when danger arises as to the possibility of occurrence of a pinching action, for example, of the hand of the operator between the slide and a stationary part of the machine frame. While the slide is then travelling over its braking distance, the hood does not continue to move on account of contact resistance but deflects to an extent corresponding to the braking distance of the slide so that no pinching can take place. The device includes means permitting the hood to be swung up transversely to the direction of movement of the slide and offers the advantage of also avoiding injury when the knitting operator exposed to possible danger in the moment of alarm withdraws his or her from the danger zone. If such a movement is made, the hood simply deflects upwardly.

The hood is expediently, rectilinearly displaceable relative to the slide in the direction of movement of the slide or it may be swivelable in the direction of movement of that slide. The possible distance of translatory or swivel movement of the hood relative to the slide is advantageously equal to the braking distance of the slide at the greatest possible velocity of slide movement. This insures that even at the highest possible slide speed, no pinching can take place despite the triggering of the stopping mechanism for the slide.

The contact devices at the respective end faces of the hood advantageously may consist of an air hose which is connected to a pressure-wave switch of the known variety. The high switching sensitivity obtainable with pressure-wave switches in conjunction with air hoses insures rapid actuation or triggering of the stopping mechanism of the knitting machine.

In accordance with a further feature of the invention, contact bars are also provided in the zone where the knitting machine is operated, which contact bars when lightly touched or slightly pressed, enable the triggering of the stopping mechanism for the knitting machine. This arrangement provides still greater safety for the operators. The contact bars in the zone where the knitting machine is operated also preferably consist of an air hose connected to a pressure-wave switch.

An embodiment of the invention is illustrated in the drawings and will now be described in greater detail.

DESCRIPTION OF THE PREFERRED EMBODIMENT

Figure 1:
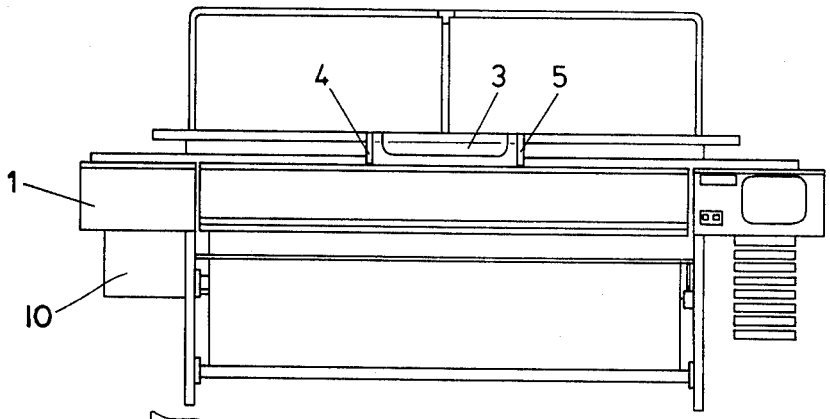
FIG. 1 is a front elevational view of a straight and circular knitting machine equipped with a safety device in accordance with the present invention.
Figure 2:
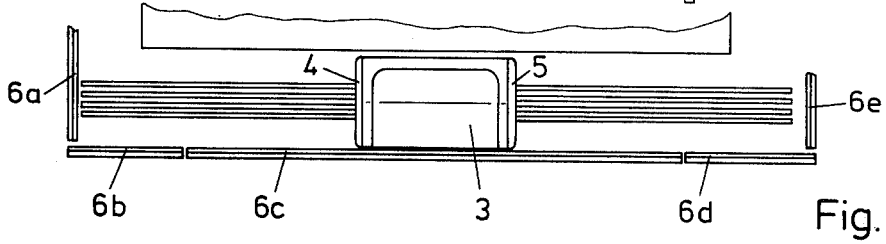
FIG. 2 is a plan view of a portion of the straight and circular knitting machine of FIG. 1.
Figure 3:
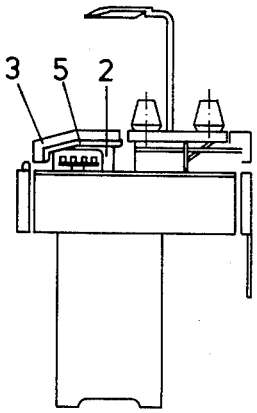
FIG. 3 is a side elevational of the machine of FIG. 1.

A knitting machine 1 is shown in FIGS. 1, 2 and 3, being fitted with a safety device in accordance with the present invention for preventing injury to the machine operator as result of pinching of the operator's hand between the movable slide of the machine and fixed parts on the machine frame. The knitting machine 1 has a slide or cam carriage mounted for longitudinal sliding movement on frame 11, the slide being equipped with a hood 3. The hood 3 is longer in terms of the direction of movement of the slide which moves longitudinally, FIG. 2, that is, in the direction of the longitudinal axis of the machine 1. The end faces of hood 3 have fitted thereto in terms of the direction of movement of the slide, contact devices 4 and 5 which are in the form of contact bars, these bars being fitted to the edges of the hood 3.

Further, continuous contact bars 6*a* to 6*e* inclusive also are provided over the entire working zone of the knitting machine 1. If one of the contact devices 4 or 5 or one of the contact bars 6*a* to 6*e* is touched, a mechanism 10 of a known kind for stopping the knitting machine is immediately triggered.

Figure 4:
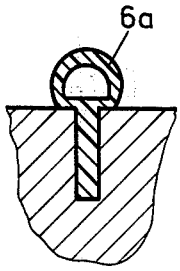
FIG. 4 is a sectional elevation of a contact bar positioned in the zone of operation of the knitting machine.

Both the contact devices 4 and 5 and the contact bars 6*a* to 6*e* are preferably constituted by air hoses. FIG. 4 shows in section the contact bar 6*a* which takes the form of an air hose. The air hoses are connected to a pressure-wave switch (not shown) of conventional form which triggers the stopping mechanism for operating the knitting machine 1. The switching sensitivity which can be achieved with pressure-wave switches insures rapid actuation or triggering of the mechanism for stopping the knitting machine, enhancing the safety features of the knitting machine.

Figure 5:
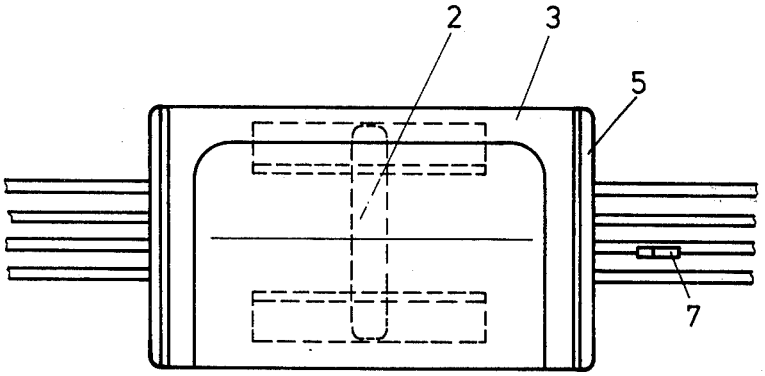
FIG. 5 is a plan view of a slide and hood of the embodiment of FIG. 1 prior to displacement of the hood relative to the slide.
Figure 6:
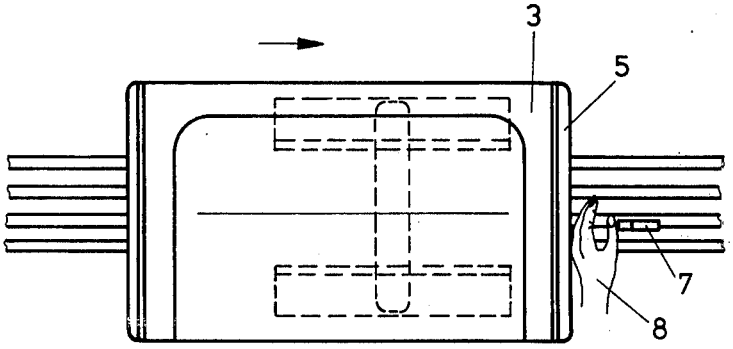
FIG. 6 is a plan view similar to that of FIG. 5 but showing displacement of the hood relative to the slide in the direction of travel of the slide upon contact of the slide with the operator's hand.

FIG. 5 shows a portion of the knitting machine which is fully illustrated in FIG. 1, including the area where pinching could possibly take place, this area being constituted by a thread-guide box 7. As mentioned previously, the length of the hood in the direction in which the slide moves, that is, the longitudinal direction of the machine 1, is greater than that of the slide 2. The hood 3 which is of light weight is mounted to the slide 2 for relative movement in the direction of the slide itself and the ends of the light weight hood 3 thus project to the left and right beyond slide 2. If, for example, while the slide is moving from left to right, FIG. 6, a hand 8 is placed between the slide 2 and the thread-guide box 7 for the purpose of handling the other, when the contact device 5 along the edge of the hood 3 touches the hand 8 of the operator, the mechanism for stopping the knitting machine is triggered and the machine 1 is turned off. The slide 2 then continues to move over its braking distance in the direction of the arrow, FIG. 6. On the other hand, the hood 3 which is mounted on the slide 2 for rectilinear displacement in the direction of slide and hood travel is further mounted such that it may be swung upwardly transversely to this direction, or alternately is mounted for swiveling and for swinging up transversely, remains stationary relative to the moving but decelerating slide which is undergoing braking and thus the hood 3 cannot cause any pinching of the hand 8 between the hood 3 and the thread-guide box 7. This situation is clearly seen in FIG. 6.

Figure 7:
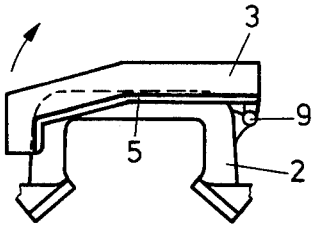
FIG. 7 is a side view of a portion of the slide showing the hood mounted for swinging upwardly relative to the slide.

FIG. 7 shows the slide 2 and the manner in which the hood 3 may be swung upwardly about a pivot pin 9 which extends parallel to the direction of movement of the slide. As a matter of fact, the pivot pin 9 may also suport the hood 3 and form the means for limited movement of the hood relative to the slide 2 in the direction of movement of that slide. The result of this arrangement permits the hood 3 to be swung up in that the hood 3 may be deflected upwardly under slight contact pressure so as to avoid injury to the operator if in the moment of alarm, he or she withdraws his or her hand from the danger area after the hood 3 moves into proximity of hand 8. It is also possible to swing the mood 3 upwardly when the slide 2 is stationary and the knitting machine has been switched off by means of the pin 9 so that the slide 2 is exposed and operational and thus servicing work may be carried out on the machine.

While the invention has been particularly shown and described with reference to a preferred embodiment thereof, it will be understood by those skilled in the art that various changes in form and details may be made therein without departing from the spirit and scope of the invention.

What is claimed is:

1. In a knitting machine including a stopping mechanism which can be triggered in the event of danger to terminate machine operation, cam carriage movable on said machine, and a hood in the zone of movement in which the cam carriage moves for protecting the machine operator, the improvement comprising:

means for mounting said hood on said cam carriage for movement with said cam carriage and relative to said cam carriage in the direction of cam carriage movement, and a contact device mounted to the face of the hood as viewed in the direction in which the cam carriage travels for triggering the stopping mechanism of the knitting machine, and wherein said means for mounting said hood for movement relative to the cam carriage comprises means for permitting displacement of said hood relative to said cam carriage through a distance corresponding to the braking distance of the cam carriage after the stopping mechanism has been triggered.

2. The knitting machine according to claim 1, wherein said means for mounting said hood for movement on said cam carriage comprises means for effecting rectilinear displacement of said hood relative to said cam carriage in the direction of movement of the cam carriage.

3. The knitting machine according to claim 1, wherein said means for mounting said hood for movement on said cam carriage comprises a pivot pin extending parallel to the direction of movement of said cam carriage to permit swinging up of the hood about the axis of the pivot pin.

4. The knitting machine according to claim 1, wherein the displacement distance for said hood relative to said cam carriage to the braking distance of the can carriage at its highest possible speed.

5. The knitting machine according to claim 1, wherein said contact device consists of an air hose.

6. The knitting machine according to claim 1, further comprising contact bars fixedly mounted in the zone in which the cam carriage moves, said contact bars veing operatively associated with said stopping mechanism and being triggerable by light contact with or slight pressure acting on said contact bars.

7. The knitting machine according to claim 6, wherein said contact bars each consist of an air hose.

* * * * *